United States Patent [19]

Anderson

[11] 3,958,089

[45] May 18, 1976

[54] ANTI-ROTATION DEVICE FOR POWER SWITCH ASSEMBLY

[75] Inventor: Ronald Vernon Anderson, St. Charles, Mo.

[73] Assignee: International Telephone and Telegraph Corporation, New York, N.Y.

[22] Filed: Nov. 21, 1974

[21] Appl. No.: 525,941

[52] U.S. Cl. ..... 200/48 KB; 403/157

[51] Int. Cl.[2] ..... H01H 31/00

[58] Field of Search ..... 200/61, 48 R, 48 P, 200/48 KB, 48 CB, 48 V, 48 SB; 174/207; 403/157, 158, 159, 79

[56] References Cited

UNITED STATES PATENTS

| | | | |
|---|---|---|---|
| 1,820,721 | 8/1931 | Withrow | 403/79 |
| 3,300,599 | 1/1967 | Lankford | 200/48 R |
| 3,813,504 | 5/1974 | Anderson | 200/48 R |

*Primary Examiner*—Robert K. Schaefer
*Assistant Examiner*—M. Ginsburg
*Attorney, Agent, or Firm*—James B. Raden; William J. Michals

[57] ABSTRACT

The disclosed device eliminates the undesired rotational movement of an installed in-line power switch of the type having a ribbed insulator through which an insulator rod is extended into metallic end fittings. The end fittings carry the electrodes or contacts of a blade switch assembly and at least one of the end fittings is adapted for pivotal mounting to the clevis member end of a strain link. The end fitting at the pivotal mounting is provided with integral projecting tongues which project away from the pivot axis and engage a surface of the clevis thereby to reduce the relative rotation between the end fitting and the clevis member about the pivotal mounting. In one embodiment the tongue includes an inclined surface adapted to wedgingly engage a corresponding inclined surface of the clevis member in a complementary relationship therewith.

12 Claims, 15 Drawing Figures

"PRIOR ART"

"PRIOR ART"

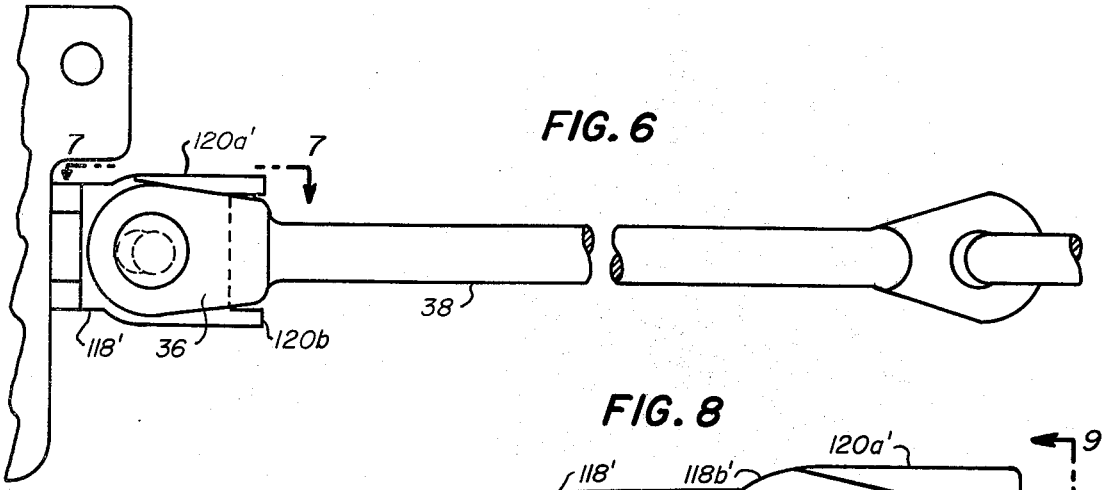
FIG. 6
FIG. 8
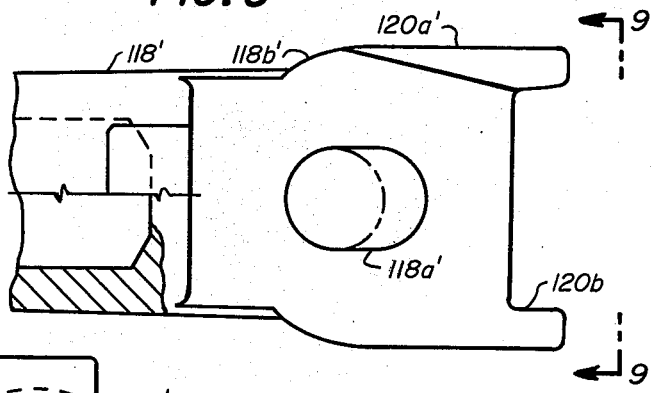
FIG. 7
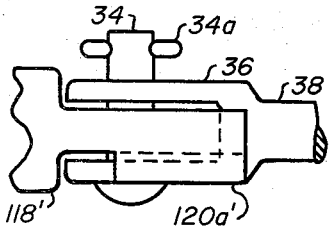
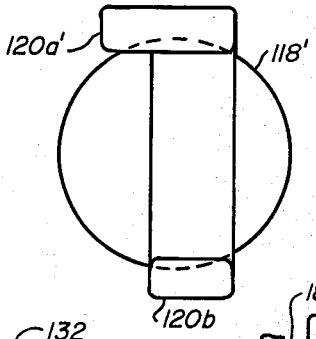
FIG. 9
FIG. 10
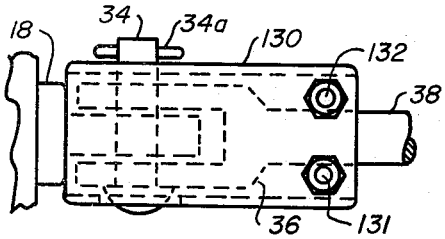
FIG. 12
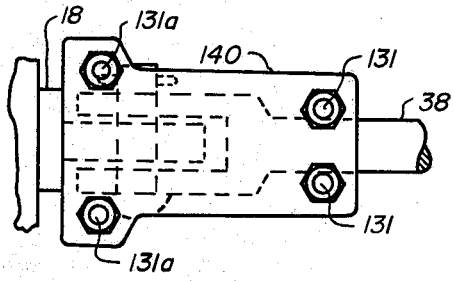
FIG. 11
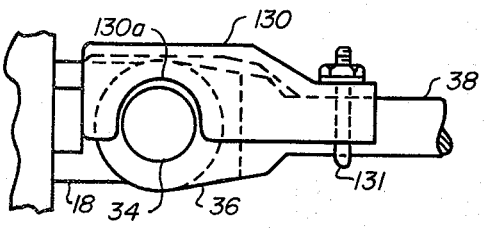
FIG. 13
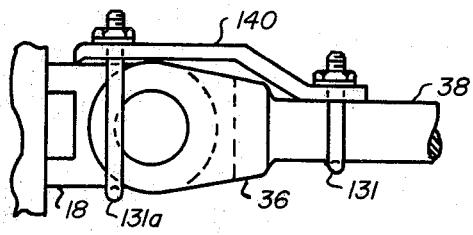

ANTI-ROTATION DEVICE FOR POWER SWITCH ASSEMBLY

BACKGROUND OF THE INVENTION

This invention relates to power switch assemblies of the type adapted for in-line mounting with a power line and having one or more end fitting members adapted for pivotal mounting to a clevis member of a strain link and, more particularly, to a device wherein the rotational movement of the switch relative to the strain link is substantially reduced.

In-line switches are known to the overhead power switchgear art and are disposed in mechanical and electrical series with power line conductors in such a manner as to provide part of the mechanical structure of the lines. The switches carry the full current in the power lines when they are closed and provide an effective open circuit in the lines when they are open, thereby to enable electrical isolation of branches of a power distribution system. The usual installation of in-line switches is accomplished with a strain link which is mechanically joined at one of its ends to a standoff insulator and the other end is mounted to an end fitting of the in-line switch. The strain link provides mechanical support between the standoff insulator and the in-line switch. The standoff insulator is mounted to a utility pole to provide both a support point or mounting location for the power line conductor and to insulate the conductor from the pole. In these installations, the end fitting of the in-line switch is pivotally mounted to a clevis member end of the strain link.

Thus, these installations typically include three pivot points, that is: a pivot point where the strain link is mounted to the insulator, the pivotal mounting of the clevis member to the end fitting, and a pivot point where the power line is connected to the other end of the in-line switch. Further, in those installations where a strain link is provided at each end fitting of the in-line switch, at least one additional pivot point results. It has been found that because of these pivot points, excessive or undesirable movement of the in-line switch results during the operation of the switch. Excessive movement can be detrimental to the function of the switch installation and may be a hazard to the lineman or operator. That is, the upward force needed during switch closing can be excessive due to the rotation occurring at the pivot points. This excessive force is necessitated by the undesirable movement of the in-line switch about the pivot points and from the in-line switch being in an abnormally high position with respect to the conductor at the time of closing. Furthermore, since switch operation is normally accomplished with an insulated and somewhat flexible switch stick or "hot stick", which can be 8 feet in length or longer, all excessive movements, and the excessive forces necessitated thereby, should be removed from the installation in order to attain reliable functioning of the in-line switch.

These and other disadvantages are overcome by the present invention wherein a device is provided for reducing or preventing relative rotation between the in-line switch and the strain link or links during the operation of the in-line switch, particularly during closing.

SUMMARY OF THE INVENTION

Briefly, a rotation reducing device for use with a power switch assembly of the type adapted for in-line mounting with a power line and of the type having at least one end fitting member adapted for pivotal mounting to a clevis member portion of a strain link is provided. The device comprises a substantially rigid member and means for fixedly connecting the rigid member to at least one of the end fitting and clevis members. Means including the rigid member and extending away from the pivotal mounting and toward the other of the end fitting and clevis members are provided for engaging the other member thereby to substantially reduce the relative rotation between the end fitting and the clevis members about the pivotal mounting.

BRIEF DESCRIPTION OF THE DRAWING

The advantages of this invention will become more readily appreciated as the same becomes better understood by reference to the following detailed description when taken in conjunction with the accompanying drawing wherein:

FIG. 6 is a fragmentary view of an in-line switch installation illustrating an alternate embodiment of the present invention;

FIG. 7 is a top view of FIG. 6;

FIG. 8 is a side view of the end fitting member of FIG. 6;

FIG. 9 is an end view of FIG. 8;

FIGS. 10 and 11 are top and side views respectively of another alternate embodiment of the present invention;

FIGS. 12 and 13 are top and side views respectively of another embodiment of the present invention; and, FIGS. 14 and 15 are top and side views respectively of still another embodiment of the present invention.

DETAILED DESCRIPTION

Figure 1:
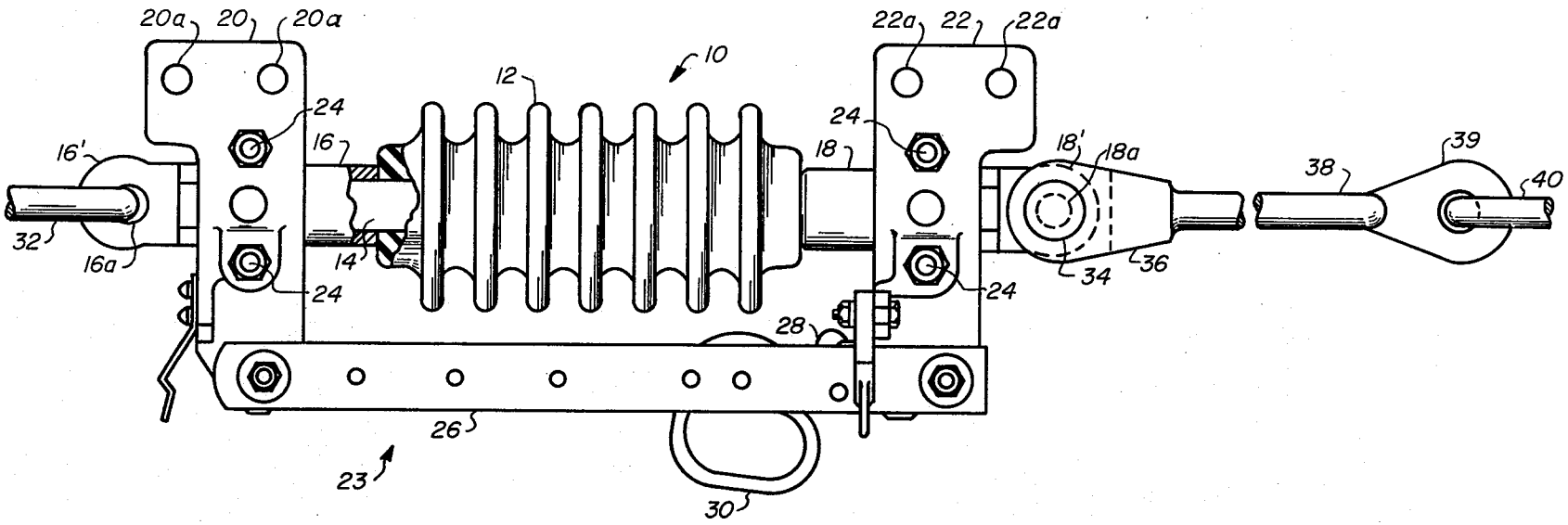
FIG. 1 is a plan view in partial section of an in-line switch according to the prior art.

Referring now to FIG. 1, there is shown a plan view of an installed, prior art in-line switch shown generally at 10. Switch 10 includes a ribbed porcelain insulator 12 through which an insulating rod 13 is extended into metallic tangs or end fittings 16 and 18. End fittings 16 and 18 are suitably attached, bonded, crimped or otherwise secured to the ends of rod 14. The electrodes 20 and 22 of a blade switch assembly 23 are secured to end fittings 16 and 18 respectively as by way of U-bolts 24. Electrodes 20 and 22 are respectively provided with fastener receiving holes **20*a* and 22*a* which accomodate electrical connections to the power line ends as by way of jumper cables (not shown). Assembly 23 includes a switch blade 26 which is hinged about contact 20 and latched to contact 22 by way of a latch 28 and a pull ring 30**.

End fitting 16 includes a flat extension 16' having a hole 16*a* disposed therein for receiving an end of a power line or a suitable intermediate fastening means 32. Similarly, end fitting 18 includes a flat extension 18' having a hole 18*a* disposed therein for receiving a pin 34. Pin 34 functions to pivotally mount a clevis member portion 36 of a strain link 38 to end fitting 18. The other end of strain link 38 includes an eye 39 or other suitable fastening means which is coupled to fastening means 40 of an associated insulator (not shown). It should be noted that in some installations, end fitting 16 also may be pivotally mounted to a clevis member portion of a second strain link.

Figure 2:
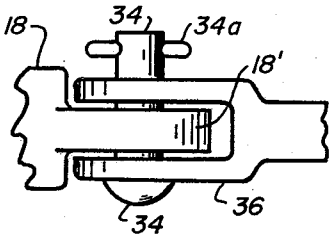
FIG. 2 is a fragmentary top view of FIG. 1 which further illustrates the pivotal mounting relationship between the end fitting and clevis members.

It can be seen by reference to FIG. 2 that pin 34 is carried within hole 18*a* of fitting 18 and corresponding holes or apertures of clevis 36 and is slidably constrained therein by means of a transverse pin 34*a*. It can be seen by reference to FIGS. 1 and 2 that in-line switch 10 is free to pivot about pivot pin 34 when force is applied to pull ring 30 during a switching operation and particularly during the closing operation. Since the assembled installation also includes pivot points at hole 16*a* of end fitting 16 and the pivot point at the other end of strain link 38, considerable movement can result when force is applied to switch assembly 10 by way of pull ring 30 during the operation of switch 10.

Figure 3:
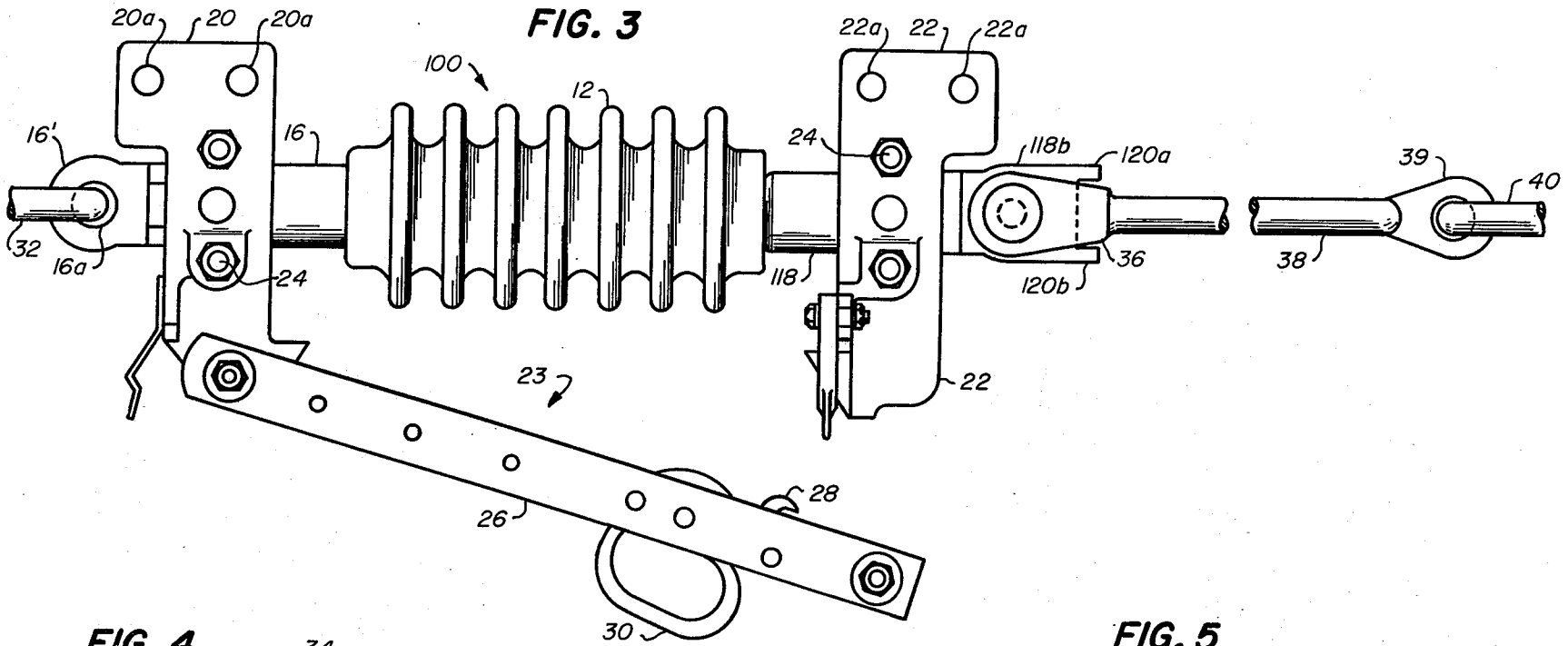
FIG. 3 is a plan view in partial section of an in-line switch in accordance with the present invention.
Figure 4:
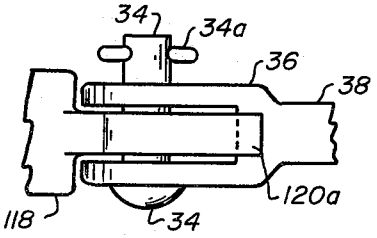
FIG. 4 is a fragmentary top view of FIG. 3 which illustrates the rotation reducing device of FIG. 3.

Referring now to FIG. 3, there is shown generally at 100 an in-line switch (in its open position) including a rotation reducing device in accordance with the present invention. FIG. 3 is similar to FIG. 1 and accordingly like elements bear like reference numerals. End fitting 118 of FIG. 3 includes two rigid tongue members 120*a* and 120*b* which project from a flat extension 118*b* and which are preferably cast and/or machined integrally with end fitting 118. Accordingly, members 120*a* and 120*b* are fixedly connected to end fitting 118. Members 120*a* and 120*b* project toward clevis member 36 and away from the pivotal mounting axis and engage clevis 36 to substantially reduce the relative rotation between end fitting 118 and clevis 36 about the pivotal mounting axis. It can be seen by reference to FIGS. 3 and 4 that a relatively small amount of rotation is permitted before either member 120*a* or 120*b* engage the corresponding surface of clevis 36; however, once engagement occurs further rotation is effectively precluded.

Figure 5:
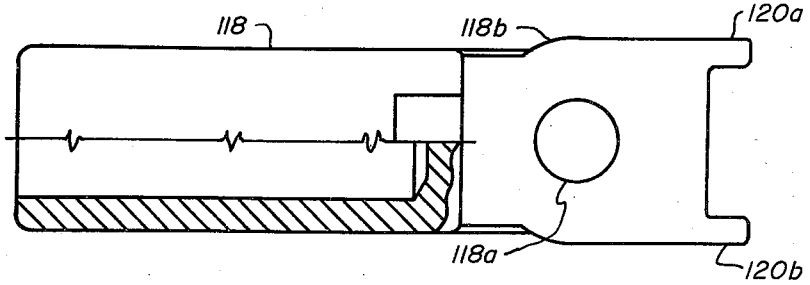
FIG. 5 is a view in partial section of the end fitting of FIGS. 3 and 4 which includes means for reducing rotation in accordance with the present invention.

Referring now to FIG. 5 there is shown a view in partial section of end fitting 118 and illustrating projecting tongue members 120*a*and 120*b*. It should be appreciated tht the physical dimensions of members 120*a* and 120*b* can be varied to suit a given application, for example, to extend the dimensions of the rigid members 120*a* and 120*b* to effectively prevent any rotation about the pivotal mounting axis.

Referring now to FIGS. 6–9 there is shown an alternate embodiment in accordance with the present invention. In this embodiment, the inclined surface of clevis member 36 is advantageously utilized to wedgingly engage a corresponding inclined surface provided on rigid member 120*a'* of an end fitting 118'. As illustrated in FIG. 8, the flat extension 118*b'* of end fitting 118' is provided with an elongated slot 118*a'* in order to facilitate the assembling of the in-line switch installation; and to thereby provide a gripping engagement between rigid member 120*a'* of end fitting 118' and clevis member 36 when tension is applied to the power line. It will be appreciated by those skilled in the art that this alternate embodiment of the present invention can be fully utilized without providing the other rigid member 120*b*. However, it will be appreciated by those skilled in the art that when the rigid members are formed as, for example, from a cast block during a machining process, both rigid members can be provided during the same machining operation. Further, the presence of the two rigid members does provide a secondary rotation reducing device in a form similar to that illustrated in FIG. 3 in the event of mechanical damage to one or both of the inclined surfaces.

Referring now to FIGS. 10 and 11, there are shown top and side views respectively of another alternate embodiment of the present invention. In this form a rigid member 130 is provided as a casting with a generally U-shaped channel which overlies the pivotal mounting between end fitting 18 and strain link 38. The sides of the channel are provided with semi-circular openings 130*a* which overlie pivot pin 34. A U-bolt 131 grippingly engages member 130 with clevis member 38. It can be seen that the other end of member 130 engages end fitting 18 to substantially reduce the relative rotation between end fitting 18 and clevis 36 about the pivotal mounting axis.

FIGS. 12 and 13 respectively illustrate top and side views of another embodiment of the present invention. In this embodiment a rigid member 140 is provided in the form of a plate which advantageously may comprise a metal stamping. Plate 140 is fixedly mounted to both strain link 38 and end fitting 18 as by way of U-bolts 131 and 131*a* respectively.

Figure 14:
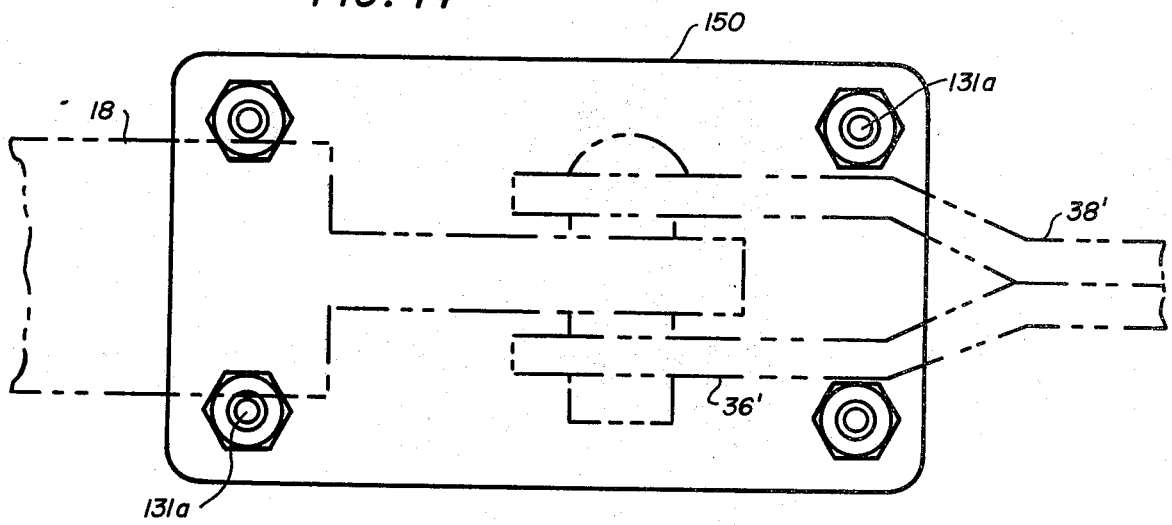
Figure 15:
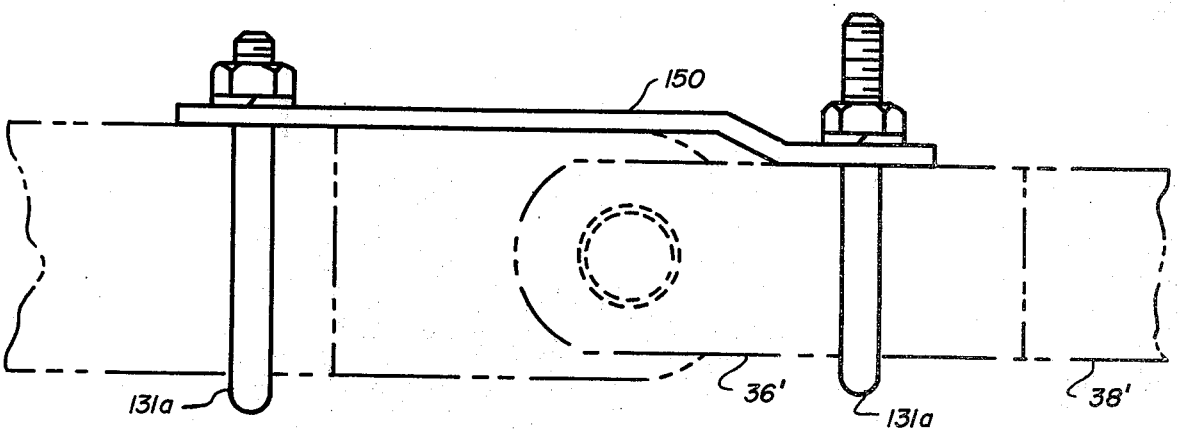

Referring now to FIGS. 14 and 15, there is shown still another embodiment of the present invention. In this form a rigid member 150 takes the form of a plate or stamping whose engaging surface is in substantially continuous contact with the end fitting 18 and clevis members 36'. It can be seen that the clevis and strain link members of FIGS. 14 and 15 are somewhat different than the strain link and clevis members shown in the previous figures. Strain links such as strain link 38' of FIGS. 14 and 15 are generally formed from flat bar stock which is suitably shaped to provide a strain link and which therefore includes a flat clevis end. Accordingly, this type of strain link does not have a corresponding inclined surface to cooperate with the form of the present invention illustrated in FIGS. 6–9. However, the form of the rotation reducing device as illustrated in FIGS. 14 and 15 in accordance with the present invention, can be utilized with strain links of this type to provide the anti-rotation advantages as provided by the other forms of the invention described herein.

It will be appreciated by those skilled in the art that the forms of the present invention illustrated in FIGS. 10–15 readily can be added to existing in-line switch installations and otherwise added onto prior art in-line switches of the type depicted in FIG. 1.

It will also be appreciated by those skilled in the art that in some in-line switch installations a strain link is utilized at both end fittings of the in-line switch with or without a standoff insulator. That is, the in-line switch may include a strain link at each end fitting and may be installed along a cable span remote from a standoff insulator. Accordingly, in those applications one or more of the foregoing forms of the present invention can be utilized to provide a rotation reducing device at both ends of the in-line switch.

What has been taught, then, is a rotation reducing device for substantially reducing or preventing relative rotation between an in-line switch and its associated strain link during the functioning of the switch particularly during a closing operation thereof. The forms of the invention illustrated and described herein are but preferred embodiments of these teachings. They are shown as illustrations of the inventive concepts, however, rather than by way of limitation, and it is pointed out that various modifications and alterations may be indulged in within the scope of the appended claims.

What is claimed is:

1. A rotation reducing device for use with a power switch assembly of the type adapted for in-line mounting with a power line and of the type having a blade switch assembly and an end fitting member connected to a strain link and adapted for pivotal mounting to a clevis member of said strain link, said device comprising:

a substantially rigid member;

means for fixedly connecting said rigid member to at least one of said end fitting and clevis members; and, said rigid member including means extending away from said pivotal mounting and toward the other of said end fitting and clevis members for engaging the other member thereby to preclude relative rotation between said end fitting and clevis members about said pivotal mounting upon engagement of said rigid member with said other member.

2. The device according to claim 1, wherein said means for fixedly connecting said rigid member comprises fastening means for fixedly mounting said rigid member to said one of said end fitting and clevis members.

3. The device according to claim 2, wherein said rigid member comprises a plate overlying said pivotal mounting and wherein said fastening means comprises a generally U-shaped bolt for grippingly engaging said plate with said end fitting and clevis members.

4. The device according to claim 1, wherein said means for fixedly connecting said rigid member comprises a continuous casting cast integrally with said end fitting and rigid members; and wherein the means for engaging the other member comprises at least one tongue portion of said rigid member projecting toward said clevis member.

5. The device according to claim 4, wherein said tongue portion includes an inclined surface adapted to wedgingly engage a corresponding inclined surface of said clevis member in a complementary relationship therewith.

6. The device according to claim 5, wherein said end fitting member includes an elongated slot adjacent to said surfaces and disposed about the pivot axis of said pivotal mounting for receiving a pivot pin extending through said clevis member and wherein said surfaces grippingly engage when tension is applied to said power line.

7. The device according to claim 4, wherein said end fitting member includes two tongues respectively disposed on opposite sides of the pivot axis of said pivotal mounting.

8. In a power switch comprising an in-line switch of the type having an insulator carried by a rod of insulating material, end fitting tangs disposed on opposite ends of said rod, a blade switch assembly mechanically depending from said end fitting tangs and one of said tangs connected to a strain link and being adapted for pivotal mounting to a clevis member of said strain link, the improvement therewith comprising means cooperating with said one of said tangs and in fixed relationship therewith for engaging said strain link to substantially preclude the relative rotation between said one of said tangs and said strain link about said pivotal mounting.

9. The power switch according to claim 8, wherein the improvement means includes means for lockingly engaging said strain link thereby to substantially fix the position of said one of said tangs relative to said strain link.

10. The power switch according to claim 9, wherein said last-mentioned means includes complementary inclined surfaces respectively disposed on said one of said tangs and said strain link for wedgingly locking said one tang with said strain link.

11. The power switch according to claim 8, wherein the improvement means includes at least one tongue member projecting from said one of said tangs.

12. The power switch according to claim 8, wherein both of said tangs are connected to respective strain links and adapted for pivotal mounting to a clevis member of said respective strain links and wherein said improvement is provided at each end of said in-line switch.

* * * * *